United States Patent [19]

Taniguchi

[11] Patent Number: 4,883,223

[45] Date of Patent: Nov. 28, 1989

[54] MAILBOX SIGNAL FLAG SYSTEM

[76] Inventor: George Taniguchi, 5102 Sorrento Dr., Boise, Id. 83704

[21] Appl. No.: 345,900

[22] Filed: May 2, 1989

[51] Int. Cl.[4] ..... B65D 91/00; A47G 29/12

[52] U.S. Cl. ..... 232/35

[58] Field of Search ..... 232/17, 34, 35

[56] References Cited

U.S. PATENT DOCUMENTS

| | | | |
|---|---|---|---|
| 1,350,515 | 8/1920 | Payne | 232/35 |
| 2,687,846 | 8/1954 | Chrisman | 232/35 |
| 2,698,712 | 1/1955 | Kreitlow | 232/35 |
| 4,150,780 | 4/1979 | Mapes | 232/35 |
| 4,449,663 | 5/1984 | Schluter | 232/35 |
| 4,738,392 | 4/1988 | Kovacs | 232/35 |

*Primary Examiner*—Robert W. Gibson, Jr.
*Attorney, Agent, or Firm*—Frank J. Dykas

[57] ABSTRACT

A mailbox flag system having mail waiting flag 13 and mail delivered flag 12 connected by control arms 31 and 36 to mailbox door 11. Expansion slots 27 and 34 are provided for slidable engagement with flag pivot pins 33 and 38 of control arms 31 and 36 to pivotally rotate mail waiting flag 13 and mail delivered flag 12 around base pivot pins from horizontal down positions to extended vertical positions from where mailbox waiting flag and mail delivered 12 and 13 can each drop into channel frame assemblies 20 and 21. When mailbox door 11 is reshut, control arm flag pivot pin 38 slides up expansion slot 34 and mail delivered flag 12 remains vertical. Mail waiting flag 13 is further provided with an arcuate extension slot 29 attached to expansion slot 27, when door 11 is reshut, flag pivot pin 33 slides from expansion slot 27 to arcuate extension slot 29, engaging the end thereof, lifting mail waiting flag 13 from channel assembly 21 and rotating it back to the horizontal down position.

3 Claims, 6 Drawing Sheets

MAILBOX SIGNAL FLAG SYSTEM

BACKGROUND OF THE INVENTION

1. Technical Field

This invention relates to a signal flag system for rural delivery mailboxes. More particularly it relates to a mailbox flag system having an automatically lowering mail waiting flag and an automatically raising mail delivered flag operably connected to a front opening mailbox door.

2. Background Art

A common method of rural delivery mail service involves the use of mailboxes located at roadside for use by a postman on a motor carrier route. In rural areas, houses are often set back substantial distances from the road, and as a result, walking the length of a driveway to check a mailbox to see if mail has been delivered can be a considerable inconvenience, especially for the elderly or infirm, or during inclement weather. As a result, it is a common practice for people living in rural areas to watch for the mail carrier every day to see whether he or she opens the mailbox to insert delivered mail.

Postal regulations generally require mailboxes openable from the front, or roadside, hinged at the bottom and opening downward. Red mail waiting flags are provided which can be elevated by the resident to indicate mail waiting for pickup by the mail carrier, but mail delivered flags are not permitted unless they function automatically since postal regulations provide that the mailman will not operate them manually.

It would be very convenient for the resident to provide a mailbox which has an automatic mail delivered flag system to indicate when the postman opens the mail door to insert delivered mail. A great deal of work has been done in this field in an attempt to develop a mail delivered flag system which will function effectively and reliably for an extended term of years and in inclement weather conditions.

Numerous devices have been developed and patented, but most of them require some sort of a spring loaded triggering device for proper operation. Examples include those taught by U.S. Pat. Nos. 3,794,240, to Myers, 4,685,612, to Rascov and 4,706,880 to Peters. While these devices, when new, may function, they all suffer from the same design defect, the failure of parts caused by corrosion and the deteriorating effects of prolonged exposure to sun and weather over a period of years. As a result, sooner or later, they usually fail requiring the replacement of the parts of the original device, or the entire mailbox assembly.

CHRISMAN, U.S. Pat. No. 2,687,846, represents one of the earlier attempts to provide a mail delivered flag that does not involve the use of the spring loaded triggering devices. Instead it utilizes a mail waiting flag fabricated of a resilient material and a lever arm designed to rotate to a horizontal capture position when the mailbox door is open, and to counter rotate with a captured mail delivered flag to a more vertical position when the door is reshut. While this is a simpler design than the spring loaded trigger systems, it still suffers from the drawback that the resilient material from which the mail delivered flag is fabricated will, over time, become brittle and break, or deform to the point where the mail delivered flag system of Chrisman in no longer captured by the rotating arm.

A recent attempt to solve the problem is taught in KOVACS, U.S. Pat. No. 4,738,392, which teaches a pair of flags, one for mail waiting, and the other for mail delivered, each operable by frictional engagement with the flanged edges of a mailbox door. Again, the system operates without the use of a spring loaded triggering device; however, it suffers from the same drawbacks in that the parts are subject to wear, corrosion, and eventual failure because of the environmental conditions. Also, the device taught by Kovacs is easily adapted for retrofit installation on existing mailboxes.

What is needed is an automatic mailbox flag system which will function in any kind of weather and whose operable mechanical systems will function regardless of the deteriorating effects of inclement weather or prolonged exposure to harsh sunlight. In the ideal system the traditionally red painted mail waiting flag can be automatically lowered by the postman when the door is opened and shut, and a yellow or orange mail delivered flag automatically raised.

Accordingly, it is an object of this invention to provide a mailbox flag system which features an automatically lowered mail waiting flag and an automatically raised mail delivered flag both operably connected to the mailbox door so that when the postman opens and then reshuts the mailbox door, the red mail waiting flag will automatically lower and the yellow mail delivered flag will automatically raise. Another object of this invention is to provide a mailbox flag system which is easily retrofittable to existing mailboxes. A third object is provide a mailbox system wherein the mechanical operation of the system will function in all but the most extreme inclement weather conditions, and whose mechanical function will not deteriorate with the deterioration and corrosion caused by prolonged exposure to sunlight and inclement weather. The final object is to provide a signal flag system which is economical to produce and easy to install.

DISCLOSURE OF INVENTION

These objects are accomplished by use of a mailbox flag system having two flags. The first a mail waiting flag, and second a mail delivered flag, both operably connected to the door of the mailbox by means of pivotally attached control arms. Both the mail waiting and mail delivered flags operate under the same mechanical theories, except in reverse order, one to the other. Generally speaking, each flag can be moved between a horizontal down position, a vertical extended position and a vertical dropped position where the flag is dropped into a channel and held vertically upright.

The mail waiting flag, painted red, is formed of unitary construction, having an elongated flag portion, and extending down therefrom a elongated channel bar. The channel bar has in its bottom portion an elongated drop slot parallel to the longitudinal axis of the channel bar for pivotal, slidable engagement with a pivot pin. The mail waiting flag is designed for positioning in three different positions, the first of which is a horizontal down position. The second is a fully extended vertical position, wherein the channel bar is vertically oriented and pulled up until further travel is stopped by engagement of a pivot pin with the bottom of the drop slot, and a third position, which is a dropped vertical position wherein the channel bar is dropped into a channel formed in a frame assembly with the pivot pin engaged with the top end of the elongated channel bar drop slot.

A control arm is pivotally attached at one end to the flange of the mail box door, and extends back to and is held inserted within a elongated expansion slot formed and positioned in the flag such that the expansion slot is horizontal when the flag is in the down position and vertical when the flag is in either the extended vertical or dropped vertical position.

Also formed integral with the mail waiting flag is an extension slot extending arcuately rearward and upwardly from the bottom of the expansion slot.

The expansion slot and the control arm are cooperatively sized such that to raise the mail waiting flag to indicate mail waiting for pickup, the resident opens the mailbox door, thereby pulling the control arm to the bottom of the expansion slot, thereby forcing the flag and control arm assembly to pivot about the pivot pin to the vertical position, whereupon the resident sets the mail waiting flag to drop into the dropped vertical position by insuring that the control arm remains in the expansion slot. The resident then inserts mail for pickup into the mailbox, and closes the door. The flag end of the control arm will travel up the expansion slot as the door is closed. The expansion slot and the control arm are cooperatively sized to prevent engagement between the flag end of control arm and the top of the pivot slot. Thus, the mail waiting flag will not leave the dropped vertical position when the door is closed.

When the postman stops to retrieve the mail held in the mailbox for pickup, and opens the door, thereby pulling the control arm down and away from the upright mail waiting flag, the flag end of the control arm will travel down the expansion slot to the bottom intersection with the arcuate extension slot. When the postman closes the door, the control arm will then travel up the shorter, arcuate extension slot, and engage the top of the extension slot, thereby lifting the flag up from the channel, until the pivot pin engages the bottom of the drop slot, whereupon the flag assembly will rotate or pivot about the pivot pin back to a horizontal down position.

The mail delivered flag functions in a similar manner except that no arcuate extension slot is provided. Thus, when the postman closes the door after delivering mail, the mail delivered control arm merely travels up the expansion slot without contacting the top end of said expansion slot, thus leaving the flag in a dropped vertical position.

The resident, upon observing that mail has been delivered can then easily reset the mail delivered flag after opening the mailbox to retrieve the delivered mail, merely by reshutting the door and lifting the mail delivered flag assembly out of the channel, and manually rotating it to the down position.

BEST MODE FOR CARRYING OUT INVENTION

Figure 1:
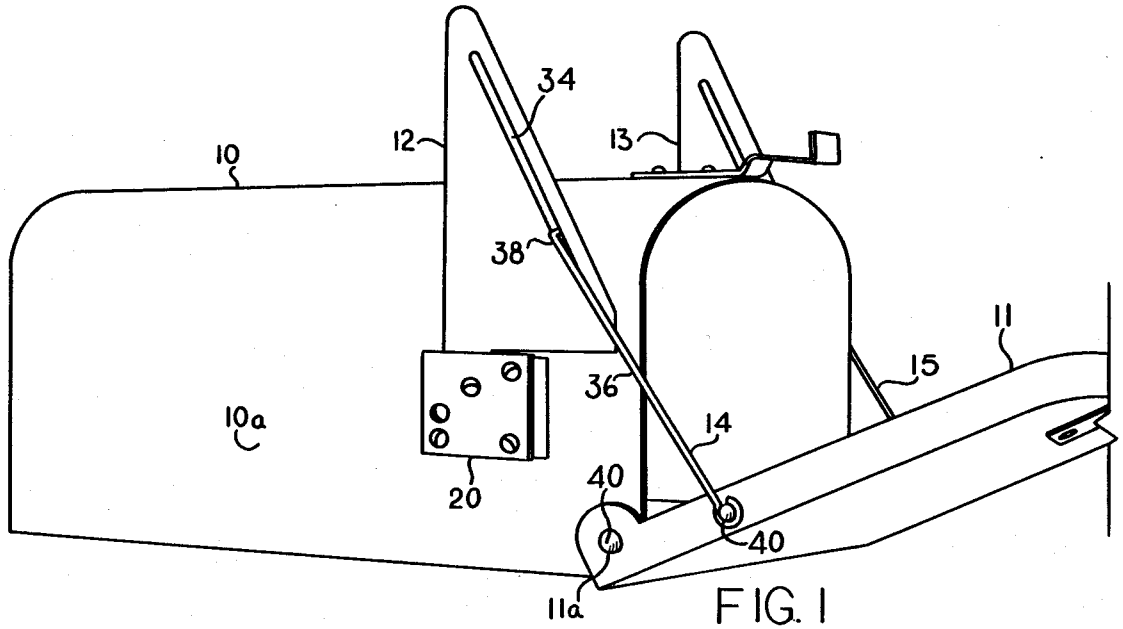
FIG. 1 is a perspective representational view of a mailbox showing the mailbox dual flag sigal system.
Figure 5B:
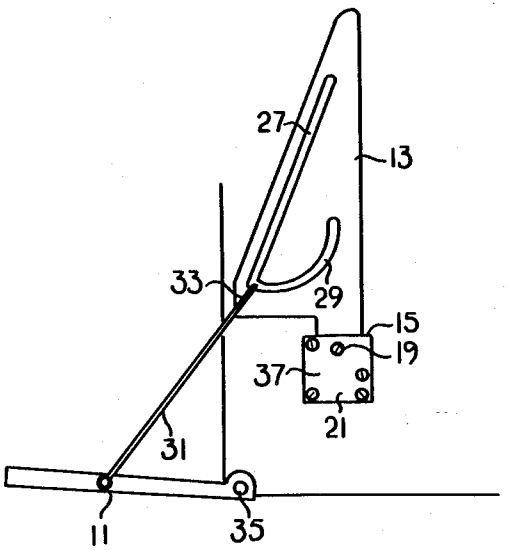
FIG. 5*b* is a representational side view of a mail waiting flag in a dropped vertical position with a mailbox door full open.
Figure 5A:
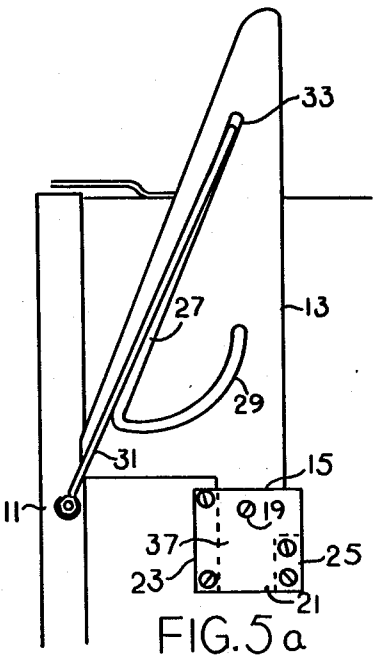
FIG. 5*a* is a representational side view of a mail waiting flag in a dropped vertical position.
Figure 5D:
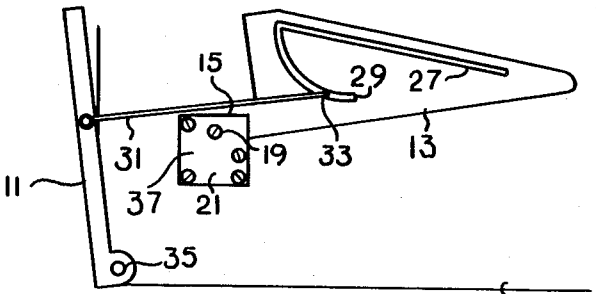
FIG. 5*d* is a representational side view of a mail waiting flag in the horizontal down position and the mailbox door nearly reclosed.
Figure 5C:
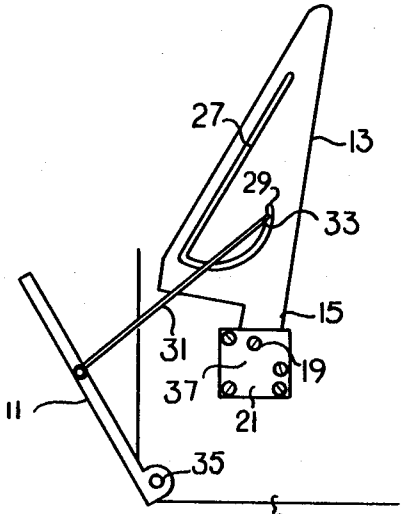
FIG. 5*c* is a representational side view of a mail waiting flag in a vertically extended position and the mailbox door partially closed.

Shown in FIG. 1, the mailbox flag system features two separate flags, the first a mail delivered flag 12, painted yellow, attached to the left side of mailbox 10 as determined when facing the front opening door 11 of mailbox 10, and mail waiting flag 13 similarly attached to the right side of mailbox 10. As can be seen from FIGS. 1, 2*a*, and 5*a*, both mail delivered flag 12 and mail waiting flag 13 are of similar, but reverse mirror image construction, one to the other. Since mail delivered flag 12 is conceptually, and functionally simpler than mail waiting flag 13, mail delivered flag 12 will be described first.

Figure 2A:
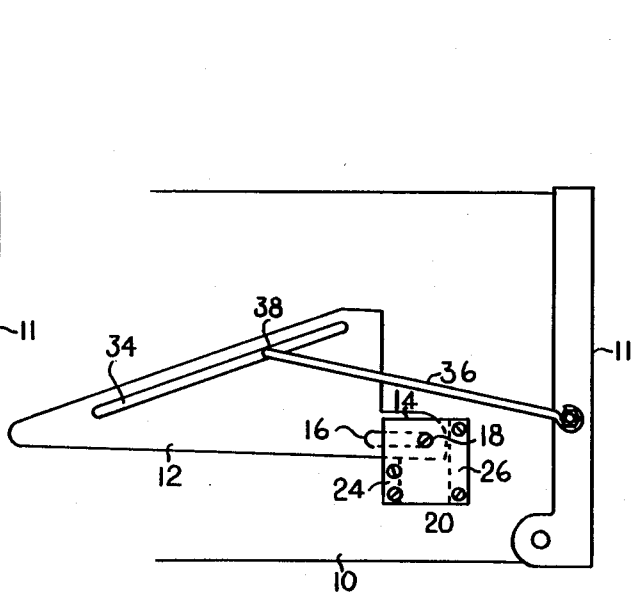
FIG. 2*a* is a sectional side view of a mail delivered flag in a horizontal down position.
Figure 2B:
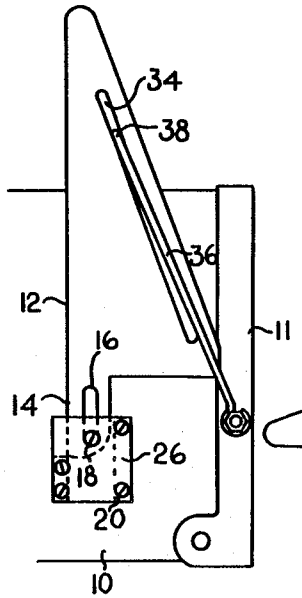
FIG. 2*b* is a sectional side view of a mail delivered flag in a extended vertical position.
Figure 2C:
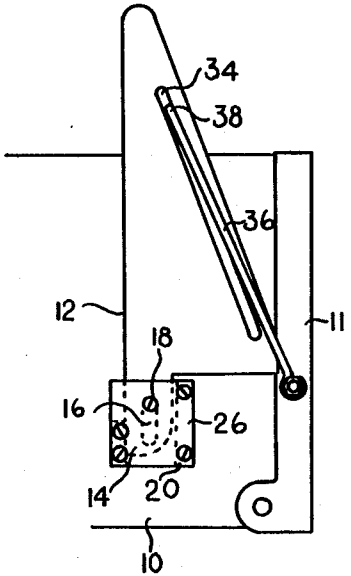
FIG. 2*c* is a sectional side view of a mail delivered flag in a dropped vertical position.

Referring to FIGS. 2*a*, 2*b*, and 2*c*, it can be seen that mail delivered flag 12, when vertically oriented, has attached to what is herein defined as its bottom edge, channel bar 14. Disposed within channel bar 14, parallel to its longitudinal axis is elongated drop slot 16 into which interfits base pivot pin 18 which is attached to and extends across a channel defined in channel frame assembly 20.

Figure 3:
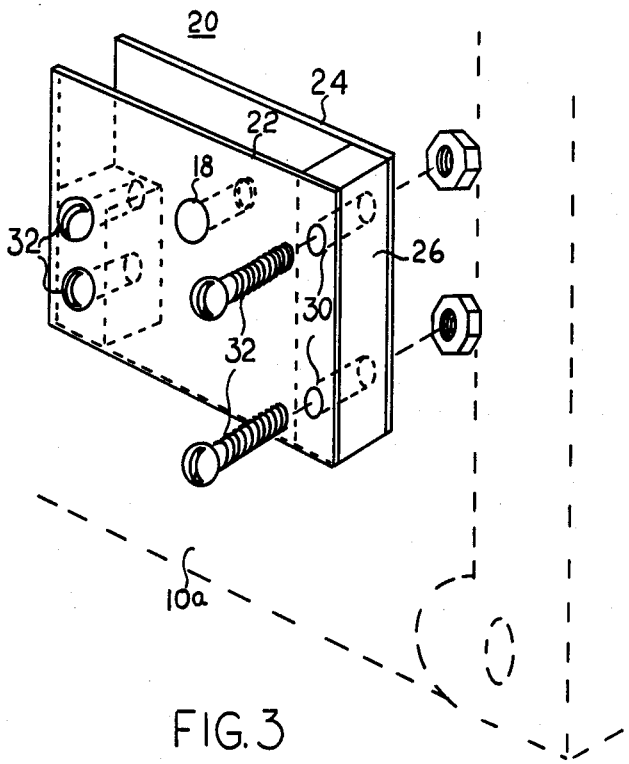
FIG. 3 is an exploded perspective representational view of a channel frame assembly having front and back face plates.
Figure 4:
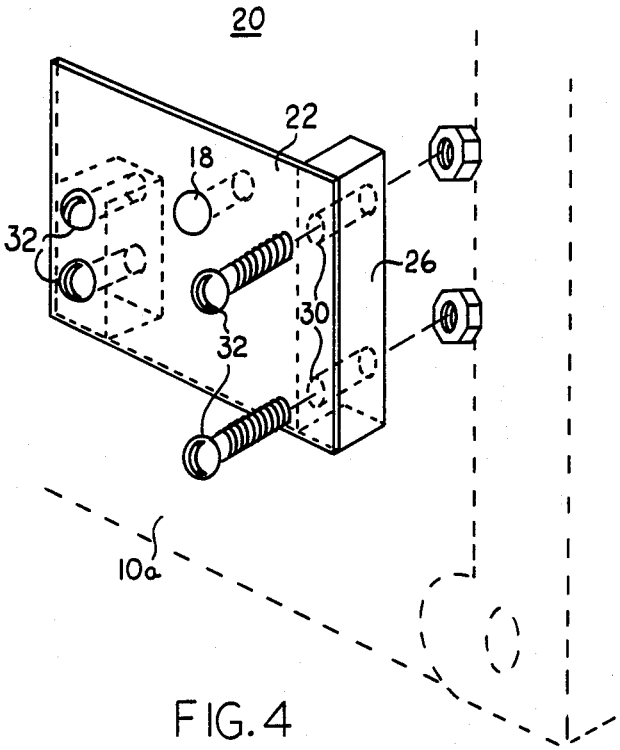
FIG. 4 is an exploded perspective representational view of channel frame assembly having a front face plate.

Channel frame assembly 20, as shown if FIGS. 3 and 4, can be fabricated in a variety of embodiments, the preferred two of which are as a complete assembly having channel frame face plate 22, back plate 24, forward brace 26, and partial back brace 28, with base pivot pin 18 extending across the channel defined within the channel frame assembly 20.

In the second preferred embodiment, as shown in FIG. 4, back plate 24 for channel frame assembly 20 is omitted, its function being served by vertical surface 10*a* of mailbox 10.

As can be seen from FIGS. 2*a*, 2*b*, and 2*c*, there are three defined positions in which mail delivered flag 12 can be positioned, the first, as is shown in FIG. 2*a*, is a dropped vertical position wherein mail delivered flag 12 is held vertical within channel frame assembly 20, and resting, at the upper end of drop slot 16 on base pivot pin 18. A second position, as shown in FIG. 2*b*, is the fully extended vertical position wherein mail delivered flag 12 is pulled vertically upward until base pivot pin 18 engages the bottom end of elongated drop slot 16. From this position it is apparent that mail delivered flag 12 can be rotated 90° counterclockwise to a third position which is the horizontal down position where channel bar 14 rests upon the top of partial back brace 24, as shown in FIG. 2*c*.

Mail delivered flag control arm 36 is provided, and as shown in FIG. 1 and FIGS. 2*a*, 2*b*, and 2*c*, is pivotably and slidably interconnected into expansion slot 34 formed integral with the mail delivered flag 12, and slidably connected at one end, by flag pivot pin 38 which is slidably held in expansion slot 34. The other end of control arm 36, is pivotally connected by means of door pivot pin 40 to the perimeter flange of mailbox door 11.

In operation, starting with mail delivered flag 12 in the horizontal down position, and mailbox door 11 shut, as shown in FIG. *2a*, a position which must be manually set as will be later described in this detailed description, flag pivot pin 38 of control arm 36 will be located near but not engaged, with the bottom end of expansion slot 34. As the postman pulls open mailbox door 11, flag end pivot pin 38 of control arm 36 slides down expansion slot 34 to engage the bottom end of expansion slot 34, thereby causing a pivotal force to rotate mail delivered flag 12 and channel bar 14 about base pivot pin 18 to an extended vertical position as shown in FIG. *2b*. Once the mail delivered flag 12 is in the extended vertical position, channel bar 14 will align with the channel defined in channel frame assembly 20, and will fall or drop into the channel whereupon it will be held in the dropped vertical position between braces 26 and 28.

When the postman recloses the door, and the distance between the connection point for door pivot pin 40 on the door perimeter flange approaches mail delivered flag 12, flag pivot pin 38 of control arm 36 will slide up expansion slot 34 to an intermediate position near, but not to, the point of engaging the top of expansion slot 34, thus allowing mail delivered flag 12 to remain vertical in the vertically dropped position as shown in FIG. *2c*. This indicates to the resident that mail has been delivered. The resident opens mailbox door 11, resulting in flag pivot pin 38 of control arm 36 traveling down expansion slot 34, then retrieves the mail and recloses door 11 without affecting the positioning of mail delivered flag 12. The resident must manually reset mail delivered flag 12 by lifting it up out of the channel and manually rotating it to the horizontal down position.

The mail waiting flag functions in a conceptually similar, but reversed manner. In this embodiment, as shown in FIGS. *5a*, *5b*, *5c*, and *5d*, a shorter, arcuate extension slot 29 is provided, and is connected to the bottom of mail waiting flag expansion slot 27. In operation, the automatic, or default position, of mail waiting flag 13 is in the horizontal down position, when the door is closed. The resident must manually raise the red flag and cause it to drop into the channel formed in channel assembly 21 by front plate 37 and a back plate (not shown), forward brace 23, and partial rear brace 25. To accomplish this the resident merely opens the mailbox door 11 causing mail waiting control arm 31 to slide to the bottom end of expansion slot 27 thereby pivotally rotating mail waiting flag 13 about mail waiting flag base pivot pin 19 to the extended vertical upright position similar to that shown for mail delivered flag 12 in FIG. *2b* Whereupon the resident must position or manually retain flag pivot pin 33 of control arm 31 in expansion slot 27. Upon reshutting the mailbox door 11, flag pivot pin 33 of control arm 31 will travel up expansion slot 27 in a similar fashion to that described for mail delivered flag 12, allowing mail waiting flag 13 to remain in the dropped vertical position similar to that of mail delivered flag 12 as shown in FIG. *2a*.

The postman, upon seeing mail waiting flag 13 in the upright position will know that there is mail in the mailbox waiting for pickup. In this situation, when the postman opens mailbox door 11, flag pivot pin 33 of control arm 31 will be pulled down to the bottom of expansion slot 27. The mailman then removes the mail from mailbox 10, and recloses mailbox door 11. However, with mail waiting flag 13, flag pivot pin 33 of control arm 31, rather than traveling back up expansion slot 27, will instead slide into arcuate extension slot 29 and engage the top end of arcuate extension slot 29 when the door is partially shut, as is shown in FIGS. *5b*, and *5c*.

As the postman continues to close mailbox door 11, channel bar 15 of mail waiting flag 13 will, in a technical sense, start to bind within channel frame assembly 21 against partial rear channel brace 25, until a sufficient force is developed to push mail waiting flag 13 and channel bar 15 up out of the channel defined by channel frame assembly 21 to a fully extended vertical position and then rotate downward around base pivot pin 19 to the horizontal down position, as shown in FIGS. *5c* and *5d*. In this manner, the action of closing mailbox door 11 automatically lowers mail waiting flag 13.

In cases where the resident desires to retrofit mail delivered flag 12 onto a existing mailbox, it is a relatively simple matter. The resident must first locate channel frame assembly 20 on vertical side 10*a* of mailbox 10, as shown in FIGS. 3 and 4, drill four holes in alignment with bolt holes 30 of channel frame assembly 20, insert bolts 32 through the holes, and fasten with conventional lock washers and nuts. The resident then brings mail delivered flag 12 to the vertical dropped position, and slides flag pivot pin 38 of control arm 36 up expansion slot 34 to a point near, but not at the top of expansion slot 34. He or she then pivots control arm 36 about flag pivot pin 38 to locate the proper point for attachment of door pivot pin 40 to the perimeter flange of mailbox door 11. A hole is then drilled through perimeter flange of mailbox door 11 and door pivot pin 40 is fastened by conventional and well known means to it. In applications where the mailbox flag system is installed upon new mailboxes as original equipment, then the necessary fastening holes can be prepunched and rivets or other fastening means used in lieu of nuts and bolts.

While there is shown and described the present preferred embodiment of the invention, it is to be distinctly understood that this invention is not limited thereto but may be variously embodied to practice within the scope of the following claims.

I claim:

1. A mail delivered flag system for attachment to a mail box having a front, downwardly opening, door, and vertical side portions, which comprises:

a mail delivered flag having an elongated flag portion for positioning in a horizontal position, a fully extended vertical position and a dropped vertical position, said flag further having an expansion slot disposed therein for generally vertical orientation when said flag is vertically oriented and generally horizontal orientation when said flag is in a down position;

an elongated channel bar aligned with and attached to the bottom of said flag, said channel bar having an elongated drop slot disposed therein parallel to the longitudinal axis of said channel bar for slidable engagement with a base pivot pin, said channel bar further adapted in size and shape for pivotal rotation about a base pivot pin from said down flag position to a fully extended vertical flag position and for slidable insertion into a channel from said fully extended vertical flag position to a dropped vertical flag position;

a channel frame assembly having a forward brace and a rear brace, for attachment to a vertical side portion of the mailbox and defining a vertical channel for slidably receiving said channel bar, with said forward brace being of substantially the same length as the defined channel, and said rear brace of a shorter length so as to allow rotation of said channel bar about a base pivot pin from a down flag position to a fully extended vertical position;

a base pivot pin positioned and attached to said channel frame assembly for slidable engagement within the channel bar drop slot to allow the channel bar to rotate from the down flag position to the fully extended vertical position and to drop from said fully extended position to the dropped vertical position;

a control arm having one end slidably engaged within the elongated expansion slot of the flag, and the other end pivotally attached to the mailbox door, said control arm sized to engage the bottom end of the expansion slot when the mailbox door is opened to rotate the channel bar about the base pivot pin from the down position to the fully extended vertical position, and when the channel bar is in the dropped vertical position, to slide within the expansion slot, when the mailbox door is reshut, without contacting the top of the expansion slot.

2. A mailbox flag system for attachment to a mailbox having a front, downwardly opening, door, and vertical side portions, which comprises:

a mail waiting flag having an elongated flag portion for positioning in a horizontal down position, a fully extended vertical position and a dropped vertical position, said mail waiting flag having an expansion slot disposed therein for generally vertical orientation when said flag is vertically oriented and generally horizontal orientation when said flag is in a down position, said mail waiting flag further having an extension slot extending arcuately rearwardly and upwardly from the bottom of the expansion slot;

an elongated mail waiting flag channel bar aligned with and attached to the bottom of said flag, said channel bar having an elongated drop slot disposed therein parallel to the longitudinal axis of said channel bar for slidable insertion into a channel from said fully extended vertical flag position to a dropped vertical flag position and further adapted in size and shape for pivotal rotation about a mail waiting flag base pivot pin from a fully extended flag position to a down flag position;

a mail waiting flag channel frame assembly having a forward brace and a rear brace, for attachment to one vertical side portion of the mailbox and defining a vertical channel for slidably receiving said mail waiting flag channel bar, with said forward brace being of substantially the same length as the defined channel, and said rear brace of a shorter length so as to allow rotation of said mail waiting flag channel bar about a mail waiting flag base pivot pin from a fully extended vertical position to a down flag position;

a mail waiting flag base pivot pin positioned and attached to said channel frame assembly for slidable engagement within the mail waiting flag channel bar drop slot to allow the mail waiting flag channel bar to rotate from the fully extended vertical position to the down flag position and to extend up from said dropped vertical position to the fully extended position;

a mail waiting flag control arm having one end slidably engaged within the connected elongated expansion and extension slots of the mail waiting flag, and the other end pivotally attached to the mailbox door, said mail waiting flag control arm sized to engage the bottom end of the expansion slot when the mailbox door is opened to rotate the mail waiting flag channel bar about the mail waiting flag base pivot pin from the down position to the fully extended vertical position, and to automatically slide into the extension slot, and to contact the top of said extension slot thereby raising the mail waiting flag to a fully extended vertical position and pivotally rotating it to the down position when the mail box door is reshut.

3. The mailbox flag system of claim No. 2 which further comprises:

a mail delivered flag having an elongated flag portion for positioning in a horizontal down position, a fully extended vertical position and a dropped vertical position, said flag further having an expansion slot disposed therein for generally vertical orientation when said flag is vertically oriented and generally horizontal orientation when said flag is in a down position;

an elongated mail delivered flag channel bar aligned with and attached to the bottom of said mail delivered flag, said mail delivered flag channel bar having an elongated drop slot disposed therein parallel to the longitudinal axis of said mail delivered flag channel bar for slidable engagement with a mail delivered flag base pivot pin, said channel bar further adapted in size and shape for pivotal rotation about a mail delivered flag base pivot pin from said down flag position to a fully extended vertical flag position and for slidable insertion into a channel from said fully extended vertical flag position to a dropped vertical flag position;

a mail delivered flag channel frame assembly having a forward brace and a rear brace, for attachment to the other vertical side portion of the mailbox and defining a vertical channel for slidably receiving said mail delivered flag channel bar, with said forward brace being of substantially the same length as the defined channel, and said rear brace of a shorter length so as to allow rotation of said mail delivered flag channel bar about the mail delivered flag base pivot pin from a down flag position to a fully extended position;

a mail delivered flag base pivot pin positioned and attached to said mail delivered flag channel frame assembly for slidable engagement within the mail delivered flag channel bar drop slot to allow the mail delivered flag channel bar to rotate from the down flag position to the fully extended vertical position and to drop from said fully extended position to the dropped vertical position;

a mail delivered flag control arm having one end slidably engaged within the elongated expansion slot of the mail delivered flag, and the other end pivotally attached to the mailbox door, said control arm sized to engage the bottom end of the mail delivered flag expansion slot when the mailbox door is opened to rotate the mail delivered flag channel bar about said base pivot pin from the down position to the fully extended vertical position, and to slide within the mail delivered flag expansion slot, when the mailbox door is reshut, without contacting the top of said expansion slot when the mail delivered flag channel bar is in the dropped vertical position.

* * * * *